United States Patent [19]

Kobayashi et al.

[11] Patent Number: 5,011,456

[45] Date of Patent: Apr. 30, 1991

[54] COIN RECEIVING AND DISCHARGING APPARATUS

[75] Inventors: Osamu Kobayashi, Saitama; Mitsugu Mikami, Kawagoe; Kenji Nishiumi, Sakado; Kenji Nakajima, Saitama, all of Japan

[73] Assignee: Kabushiki Kaisha Nippon Conlux, Japan

[21] Appl. No.: 370,245

[22] Filed: Jun. 22, 1989

[30] Foreign Application Priority Data

Jun. 22, 1988 [JP] Japan ..... 63-81680[U]
Jul. 9, 1988 [JP] Japan ..... 63-170035
Oct. 19, 1988 [JP] Japan ..... 63-135531[U]

[51] Int. Cl.[5] ..... G07D 1/00

[52] U.S. Cl. ..... 453/32; 453/37; 453/45; 74/45; 74/48

[58] Field of Search ..... 453/21, 37, 32, 41, 453/44, 45, 61, 62; 74/45, 48

[56] References Cited

U.S. PATENT DOCUMENTS

| | | | |
|---|---|---|---|
| 3,366,127 | 1/1968 | Breitenstein | 453/21 |
| 3,435,833 | 4/1969 | Tanaka | 453/21 |
| 3,844,298 | 10/1974 | Schweitzer | 453/61 X |
| 4,010,765 | 3/1977 | Clay | 453/21 |
| 4,221,227 | 9/1980 | Heiman | 453/44 X |
| 4,250,905 | 2/1981 | Kobayashi et al. | 453/41 |
| 4,834,689 | 5/1989 | Levasseur | 453/41 X |

FOREIGN PATENT DOCUMENTS

| | | | |
|---|---|---|---|
| 38243 | 5/1922 | Norway | 74/48 |
| 119749 | 10/1918 | United Kingdom | 74/48 |
| 639967 | 7/1950 | United Kingdom | 74/45 |

*Primary Examiner*—Robert P. Olszewski
*Assistant Examiner*—Boris Milef
*Attorney, Agent, or Firm*—Bruce L. Adams; Van C. Wilks

[57] ABSTRACT

An apparatus for receiving and discharging coins is disclosed. The apparatus includes two vertical coin cases aligned in the forward/rearward direction and separated from each other through a partition plate and having open lower ends; a T-shaped coin inlet operatively connected to the respective coin cases; a plate-like guide member horizontally secured to the open lower ends of the coin cases and having a coin passing hole the center of which is positioned just under a lower end of the partition plate; a sliding plate mounted on the guide member so as to be movable forward/rearward and having a coin accepting hole which accepts one coin from the coin cases and traverses right over the coin passing hole to thereby drop down the coin through the coin passing hole when the sliding plate is moved; driving mechanism for reciprocating the sliding plate forward and rearward; and a controlling system for controlling the driving mechanism such that the sliding plate is operated according to a given coin discharging manner.

23 Claims, 9 Drawing Sheets

COIN RECEIVING AND DISCHARGING APPARATUS

BACKGROUND OF THE INVENTION

The present invention relates to a coin receiving and discharging apparatus equipped in a vending machine, a money exchanging machine, a money automatically-discharging machine, or the like, and particularly relates to a small-sized coin receiving and discharging apparatus having two coin cases for accepting coins, which are the same or different in kind from each other, and for selectively discharging the coins from the coin cases.

An apparatus provided with a plurality of coin tubes so as to selectively discharge coins from the coin tubes is disclosed, for example, in U.S. Pat. Nos. 3,690,332 and 4,121,603 issued on Sept. 12, 1972 and Oct. 24, 1978 respectively, and in Japanese Patent Post-examination Publication No. 57-19833 published on Apr. 24, 1982. In such a conventional apparatus, however, the coin tubes are disposed side by side in the left and right direction with respect to the front surface having a coin discharge opening. Accordingly, when the apparatus is installed in a place, a relatively wide use frontage is required in the place, while the depth of the place can not be effectively used when the place has much room in depth. Prior to the present invention, Osamu KOBAYASHI, one of the inventors of this application invented a coin discharging apparatus as described hereunder and disclosed the apparatus in the above-mentioned Japanese Patent Post-examination Publication No. 57-19833. The apparatus according to the prior invention has a mechanism in which there are provided two coin tubes disposed side by side in the left and right direction, and a horizontally pivotally movable fan-shaped plate disposed under the lower ends of the coin tubes and having two coin accepting holes each for accepting one coin, whereby the plate is pivotally reciprocated by the operation of a solenoid so that the plate receives coins alternately from the coin tubes and succeedingly discharges the received coins through a single coin passing hole provided under the plate. However, the apparatus is configured such that the fan-shaped plate is horizontally pivotably moved over the two coin tubes disposed side by side in the left and right direction, and a large space is therefore required. Thus, the apparatus is disadvantageous in that not only the apparatus becomes large in size but in the case where the apparatus is mounted on the side surface of a coin selecting apparatus, a vending machine, or the like, having sufficient room particularly in depth, the depth of the coin selecting apparatus, the vending machine, or the like can not be used effectively.

SUMMARY OF THE INVENTION

It is an object of the present invention to provide a coin receiving and discharging apparatus in which the disadvantages of the aforementioned prior art apparatus is eliminated to make the apparatus small in size.

It is another object of the present invention to provide novel coin introducing means for inserting coins respectively into two coin cases arranged side by side in the front and rear direction of the apparatus.

It is a further object of the present invention to provide novel means for selectively discharging coins in various manners from the two coin cases arranged side by side in the front and rear direction of the apparatus.

In order to achieve the above objects, according to the present invention, the coin receiving and discharging apparatus constituted by a coin receiving unit and a coin discharging unit removably connected to each other has the following configuration.

That is, the coin receiving unit is constituted by: a housing vertically extending in the form of a hollow square pillar and having a front side, a rear side and left and right sides, the housing being longer in depth than in width; front and rear coin cases formed by dividing the interior of the housing with a partition plate extending in parallel with the front and rear sides of the housing for receiving coins in a horizontally piled state, the front and rear coin cases having respectively open lower ends positioned in one and the same horizontal plane; a pair of coin inserting slits formed in an upper portion of the front side of the housing; coin introducing means provided in the housing for selectively introducing coins from the respective coin inserting slits into the front coin case and the rear coin case; and coin guiding means provided under the front and rear coin cases for selectively accepting at least one of two coins lying in the respective lowest layers in the front and rear coin cases and successively dropping the at least one coin into the coin discharging unit. The coin guiding means is constituted by a plate-like guide member horizontally secured to the respective open lower ends of the front and rear coin cases and having a coin passing hole the diameter of which is not less than a coin diameter and the central axis of which is positioned just under a lower end of the partition plate, and a sliding plate mounted on an upper surface of the guide member so as to be movable forward/rearward between the open lower ends and the guide member and having a coin accepting hole which has a diameter not less than the coin diameter and an edge thickness substantially equal to a coin thickness and traverses right over the coin passing hole of the guide member when the sliding plate is moved, the sliding plate having a socket formed in a lower surface thereof to open downward.

The coin discharging unit is constituted by a coin discharge section detachably disposed under the coin guiding means of the coin receiving unit for discharging a coin dropped by the coin guiding means to the exterior of the coin discharging unit, driving means detachably engaged with the socket of the sliding plate of the coin guiding means for horizontally reciprocating the sliding plate forward and rearward, and controlling means for controlling the driving means so that the sliding plate is actuated to operate, to reciprocate and to stop in accordance with a selected coin discharge manner.

According to the present invention, coins can be inserted into the two coin cases disposed side by side in the front and rear direction without providing any structure portion projected outside from the two coin cases, and the coins are guided from the coin cases to the coin discharge section by the sliding plate arranged to reciprocate forward and rearward within the range just under the coin cases, so that it is possible to effectively receive and discharge coins in a small space. Accordingly, the apparatus can be small-sized, and in the case where the apparatus is mounted on the side surface of a coin selecting apparatus having sufficient room particularly in depth, the depth of the coin selecting apparatus can used effectively. Further, the operation of the sliding plate can be divided into forward-half portion reciprocating movement in connection with the front coin case and rearward-half portion reciprocating movement in connection with the rear coin case, or can be made to be reciprocating movement over the front and rear coin cases, so that the discharge of coins can be performed in various manners.

BRIEF DESCRIPTION OF THE DRAWINGS

The accompanying drawings illustrate embodiments of a coin receiving and discharging apparatus according to the present invention, wherein.

DETAILED DESCRIPTION OF PREFERRED EMBODIMENT

Figure 1:
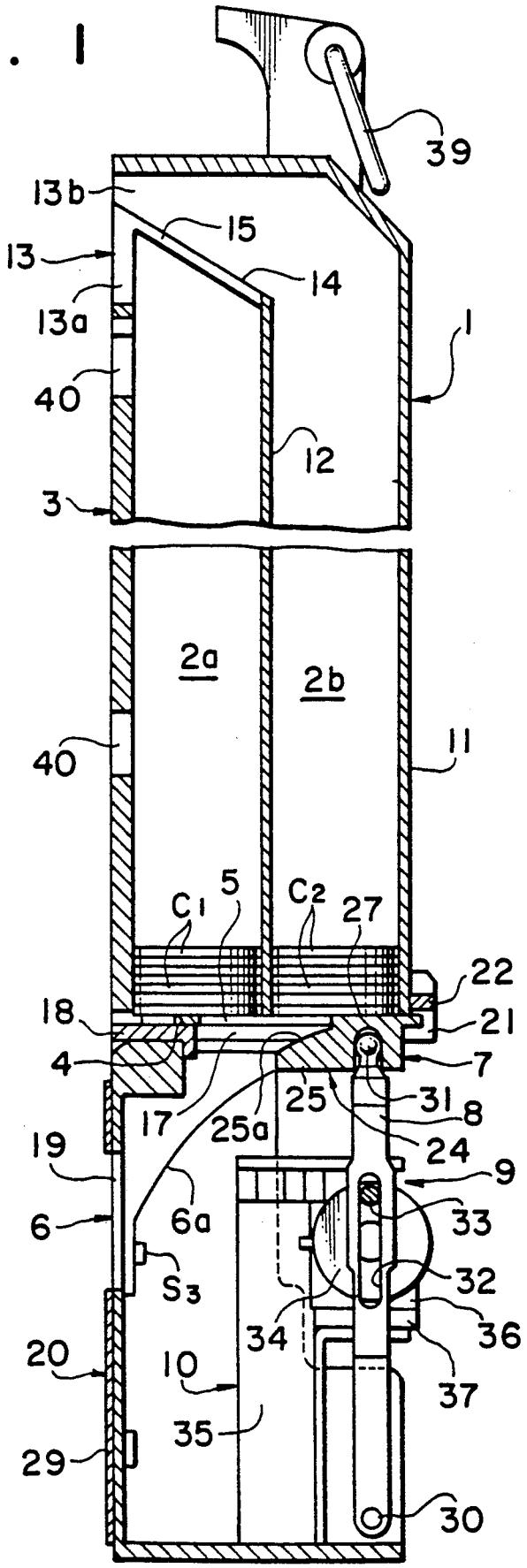
FIG. 1 is a partially-broken longitudinal sectional view of the whole of the apparatus.

Referring to FIGS. 1 through 5 and FIGS. 6*a* through 6*f*, an embodiment of the coin receiving and discharging apparatus according to the present invention will be described. FIG. 1 shows the whole of the coin receiving and discharging apparatus of the embodiment. The apparatus is constituted by a coin receiving unit 3 and a coin discharging unit 20 which will be described in detail hereunder.

Figure 2:
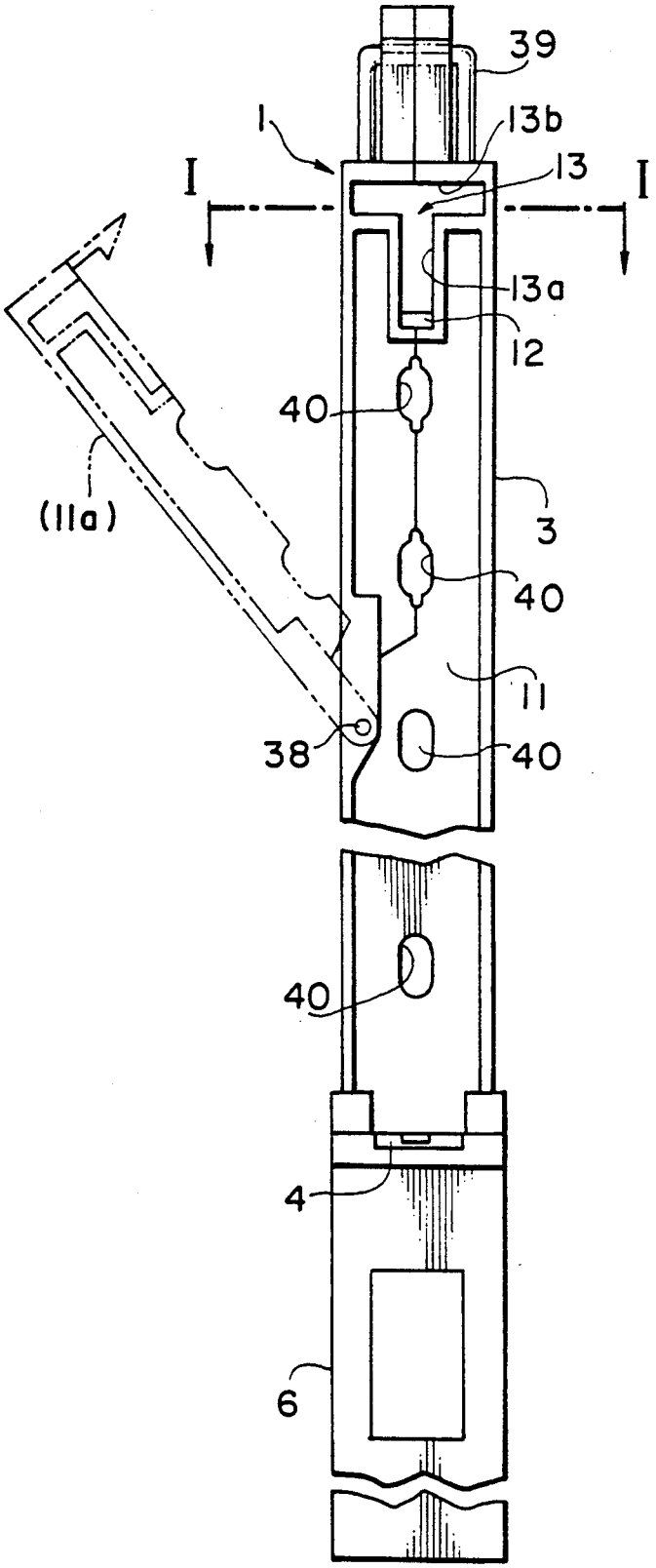
FIG. 2 is a partially-broken front view of the whole of the apparatus.

Referring to FIGS. 1 and 2, the coin receiving unit 3 is constituted by: a vertically-extending hollow square pillar housing 11 having a front side, a rear side, and left and right sides, the housing being longer in depth than in width; front and rear coin cases 2*a* and 2*b* which are formed by dividing the interior of the housing 11 with a partition plate 12 extending in parallel with the front and rear sides of the housing 11, the front and rear coin cases 2*a* and 2*b* having opening lower ends thereof positioned in one and the same horizontal plane; a coin inlet 13 constituted by a pair of coin inserting slits formed in an upper portion of the front side of the housing 11 so as to communicate with the front and rear coin cases 2*a* and 2*b* respectively; and coin guiding means 7 provided under the open lower ends of the coin cases 2*a* and 2*b* for selectively accepting the coins lying in the respective coin cases 2*a* and 2*b* and dropping the coins into the coin discharging unit 20.

Figure 4:
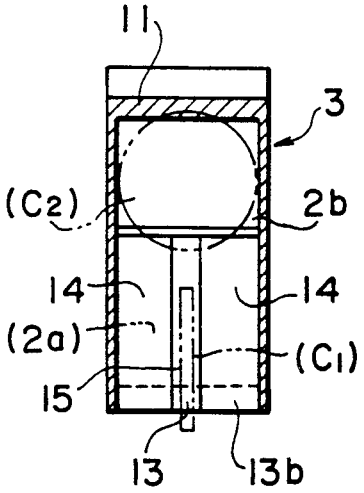
FIG. 4 is a sectional view taken along line I—I of FIG. 2.
Figure 3:
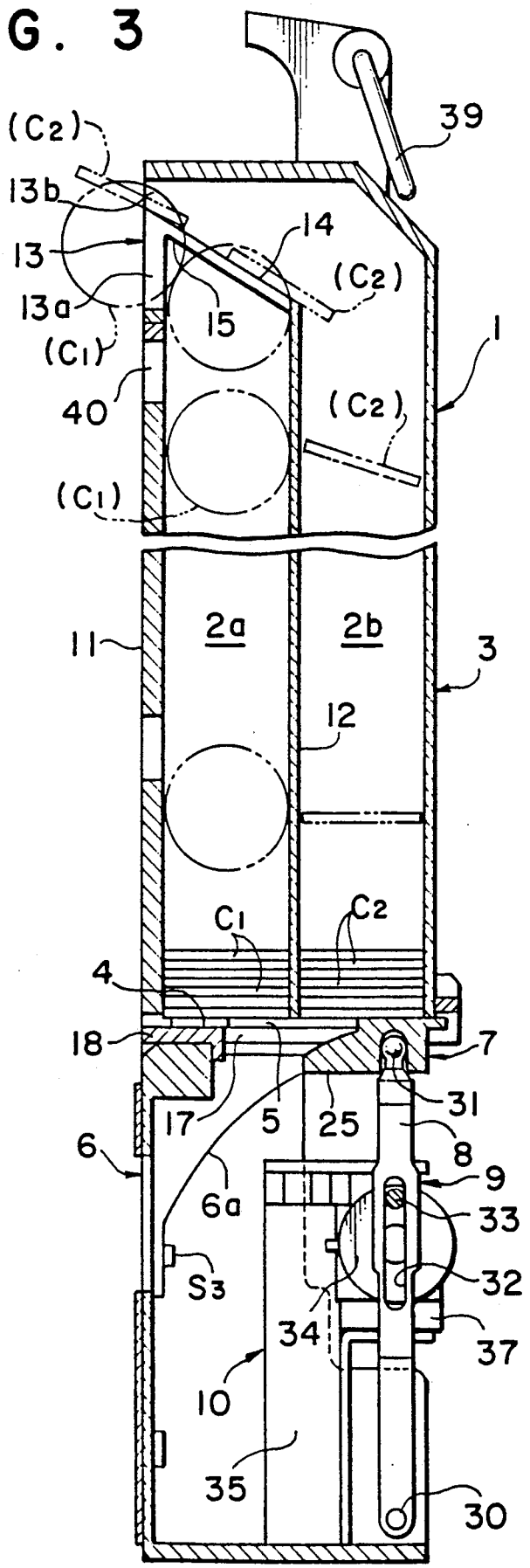
FIG. 3 is a sectional view showing the process in which coins are inserted into the apparatus of FIG. 1.

The same kind or different kinds of coins $C_1$ and $C_2$ inserted from the coin inlet u3 are introduced into the front and rear coin cases 2*a* and 2*b* respectively and stored in the horizontally piled state. As coin introducing means, in the embodiment, the coin inlet 13 is constituted by a vertical slit for a coin-$C_1$ inlet 13*a* and a horizontal slit for a coin-$C_2$ inlet 13*b* which are combined to form a T-shaped coin inlet. A guide plate 14 inclined from a lower edge of the horizontal slit 13*b* downward to the upper end of the partition plate 12 is provided so as to cover the upper end of the front coin case 2*a*. A slit 15 elongated from the slit 13*a* to the upper end of the partition plate 12 is formed in the guide plate 14 so that the coin $C_1$ is vertically inserted from the vertical slit 13*a* into the front coin case 2*a*. The coin $C_2$ is slid from the slit 13*b* on the guide plate 14 and stored in the rear coin case 2*b*. FIGS. 3 and 4 show this novel structure in detail and the state where coins are being inserted.

Figure 5:
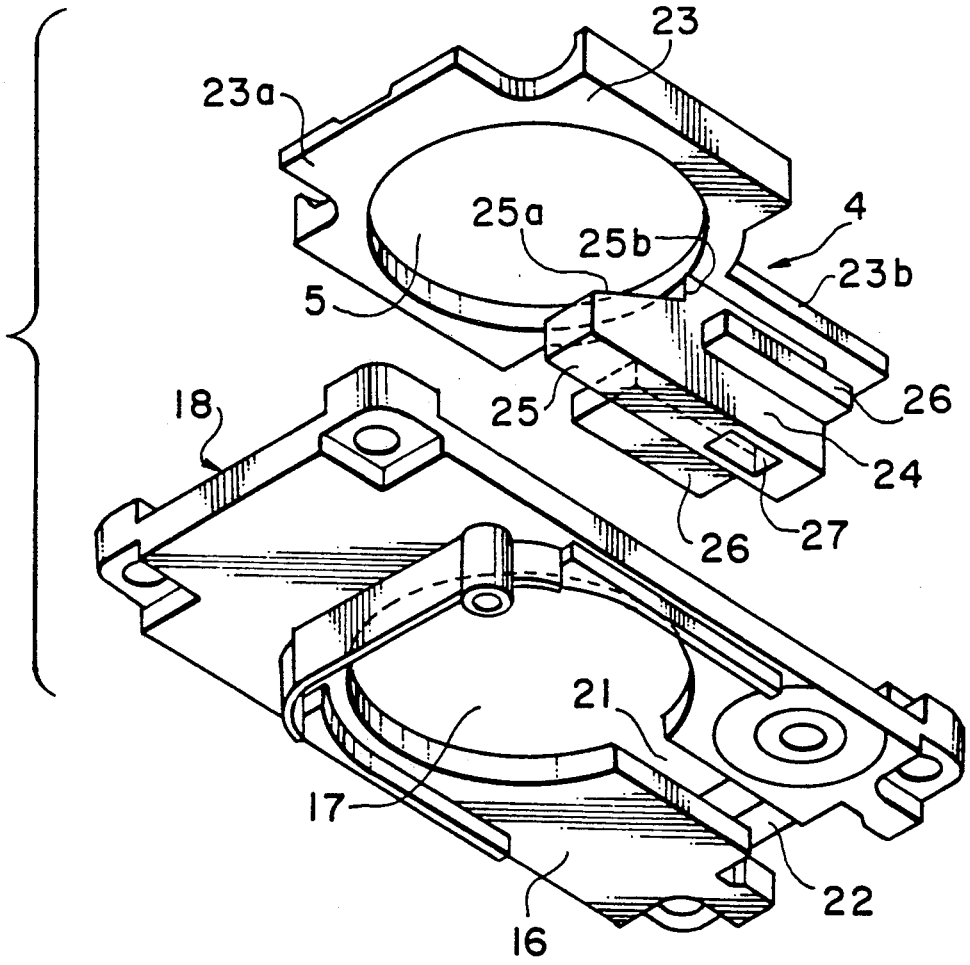
FIG. 5 is an exploded perspective view of the coin guiding means in the apparatus of FIG. 1.

Referring to FIGS. 1 and 5, the coin guiding means 7 is constituted by a substantially plane-like guide member 18 and a sliding plate 4 slidably mounted on the upper surface of the guide member 18.

The guide member 18 is constituted by a quadrangular plate 16 horizontally fixed to the respective open lower ends of the front and rear coin cases 2*a* and 2*b*, and a coin passing hole 17 formed in the central portion of the quadrangular plate 16 and having a hole diameter which is substantially equal to or a little larger than the diameter of the coins. The coin passing hole 17 is formed so that the central axis of the coin passing hole 17 is just under the lower end of the partition plate 12. Further, a guide slit 21 is formed in the rear portion of the plate 16 so that the slit 21 communicates at its one end with the coin passing hole 17, extends along a longitudinal central line of the quadrangular plate 16, and opens at its other end in the rear edge of the plate 16. A rear connecting strip 22 is provided on the rear upper surface of the plate 16 so as to straddle the guide slit 21.

The sliding plate 4 has a thickness substantially equal to the thickness of one coin and is constituted by a base plate 23 and a coin accepting hole 5. The base plate 23 is constituted by a wide front portion 23*a* and a narrow rear portion 23*b* and mounted on the plate 16 of the guide member 18 so as to be slidable forward/rearward between the plate 16 and the respective open lower ends of the front and rear coin cases 2*a* and 2*b*. The coin accepting hole 5 is formed in the central portion of the wide front portion 23*a* so as to have a diameter sufficient to horizontally accept one coin and so as to traverse just above the coin passing hole 17 of the guide member 18 as the base plate 23 is moved. An engage member 24 elongated in the front and rear direction is provided on the central portion of the lower surface of the narrow rear portion 23*b* of the plate 23 so that the engage member 24 is slidably fitted in and passed through the guide sit 21 of the guide member 18 so as to project downward below the plate 16. The front end of the engage member 24 is formed at its lower portion into a protrusion 25 so as to slightly face a portion just under the coin accepting hole 5, and also it is formed at its upper portion into a step 25*b* having a surface curved along the circumference of the coin accepting hole 5 adjacent to the protrusion 25. The protrusion 25 is formed so as to have an inclined surface 25*a* inclined forward downward from the lower edge of the step 25*b*. Further, a pair of elongated support strips 26 and 26 are secured to the opposite sides of the engage member 24 so as to slidably sandwich the plate 16 of the guide member 18 between the support strips 26 and 26 and the lower surface of the narrow rear portion 23*b* of the sliding plate 4. A socket 27 opened downward is formed on the rear lower surface of the engage member 24 so as to be removably and slidably engaged with a hemispherical upper end 31 of a pivotal lever 8 which will be described later.

Referring to FIG. 1, the coin discharging unit 20 is constituted by: a coin discharge section 6 for accepting the coins which are taken out from the coin cases 2*a* and 2*b* and dropped down by the operation of the coin guiding means 7 of the coin receiving unit 3 and for discharging the coins to the exterior of the coin discharging unit; driving means detachably engaged with the socket 27 of the sliding plate 4 of the coin guiding means 7 for horizontally reciprocating the sliding plate 4; and controlling means for controlling the operation of the driving means so that the sliding plate 4 of the coin guiding means 7 is moved to accept at least one of the coins in the front and rear coin cases 2*a* and 2*b* into the coin accepting hole 5 and successively to drop the coin into the coin discharge section 6 through the coin passing hole 17 at each reciprocation of the sliding plate 4. The coin discharge section 6 has a coin discharge opening 19 provided in the front surface of the coin discharge section 6 for taking out coins to the exterior, and a coin guiding surface 6*a* so that the coins dropped from the coin guiding means 7 can slide down to the coin discharge opening 19.

The driving means is constituted by a driving motor 37, a rotary disc 34 rotated by the motor 37 through a gearing mechanism 36 operatively connected to the motor 37, and a movement converting mechanism 9 for converting the rotation of the rotary disc 34 into the horizontal linear movement of the sliding plate 4 of the coin guiding means 7. The movement converting mechanism 9 is constituted by: a crank pin 33 on the circumferential portion of the rotary disc 34; a pivotal lever 8 substantially vertically extending adjacent to and in parallel with the rotary disc 34 and having a lower end pivotably connected to a pivot shaft 30 projected inward from the side rear lower portion of a casing 29 surrounding the coin discharging unit 20 and the hemispherical upper end 31 engaged with the socket 27 of the engage member 24 as described above; and a slide slot 32 formed longitudinally in the middle portion of the pivotal lever 8 so that the slide slot 32 receives the crank pin 33 so as to slidably engage with the crank pin 33. In such a configuration, when the rotary disc 34 is rotated forward or reversely, the pivotal lever 8 is inclined forward or rearward around the pivot shaft 30 as the crank pin 33 moves circumferentially, so that the sliding plate 4 is moved horizontally forward/rearward.

Figure 6A:
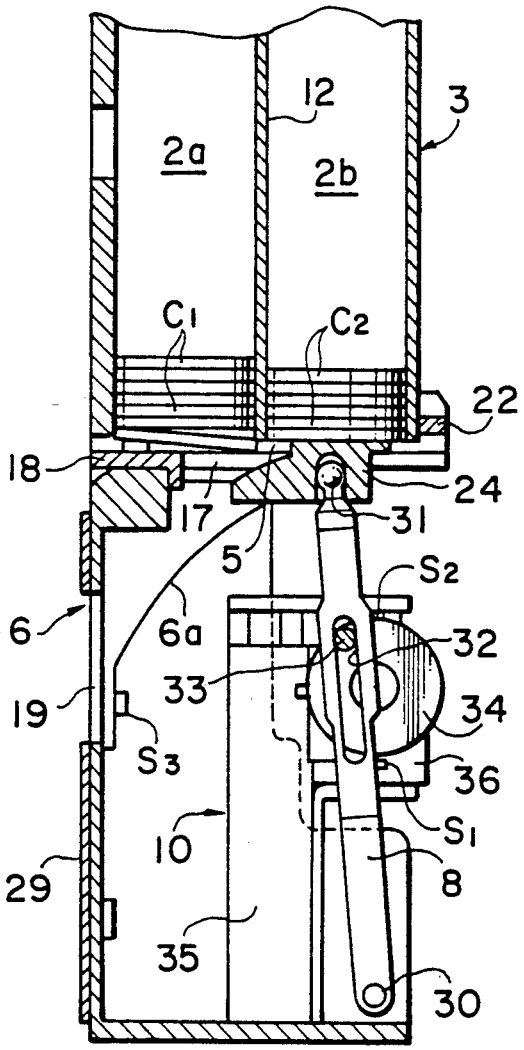
FIGS. 6*a* through 6*f* are sectional views showing the operation of the main portion of the reciprocatively driving mechanism of the apparatus in FIG. 1.
Figure 6B:
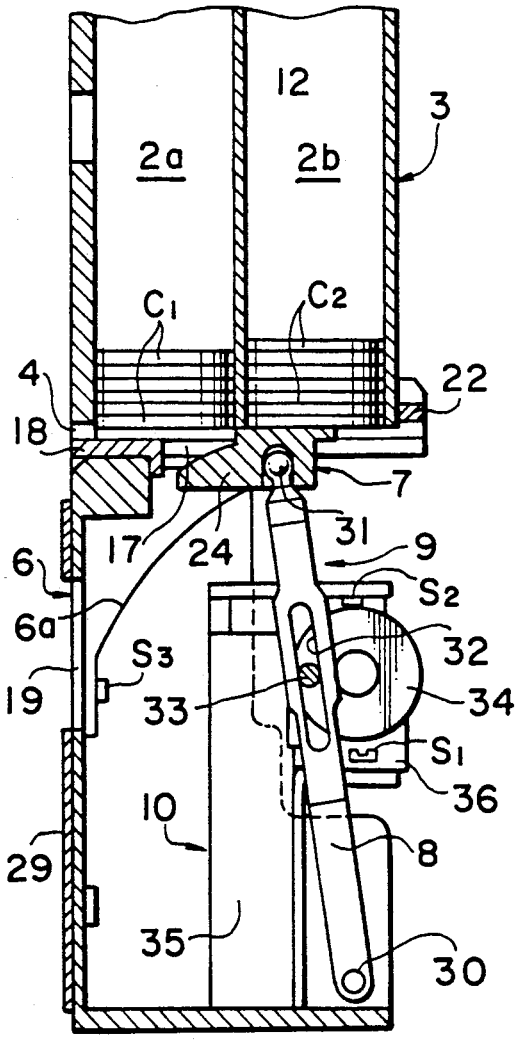
Figure 7:
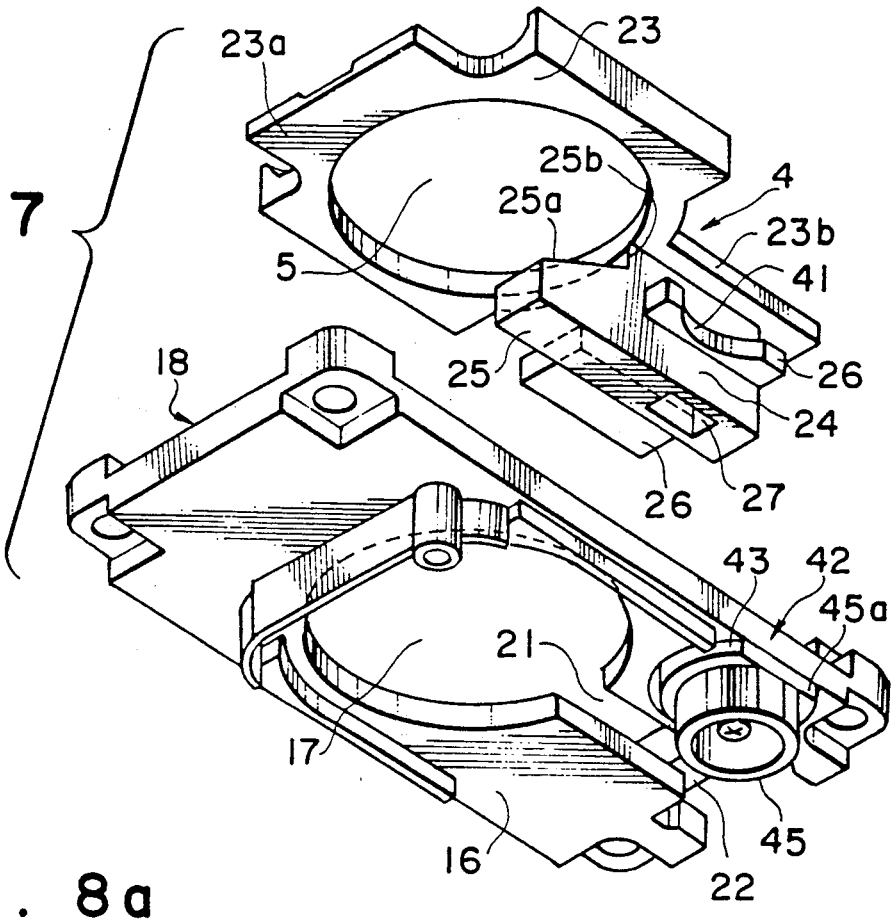
FIG. 7 is an exploded perspective view of another embodiment of the coin guiding means according to the present invention.

Referring to FIGS. 1, 6*a* and 6*b*, the controlling means is constituted by a first switch $S_1$ actuated when the coin accepting hole 5 being moved is located just under the coin case 2*a* so as to accept a coin from the coin case 2*a* and having means for making a first signal corresponding to this actuation; a second switch $S_2$ actuated when the coin accepting hole 5 being moved is located just under the coin case 2*b* so as to accept a coin from the coin case 2*b* and having means for making a second signal corresponding to this actuation; a third switch $S_3$ actuated whenever one of the coins $C_1$ and $C_2$ received in the coin accepting hole 5 being moved is dropped into the coin discharge section 6 through the coin passing hole 17 and having means for making a third signal corresponding to this drop; and a controller 35 for receiving the first, second and third signals and controlling the operation of the motor 37 in response to each of the first second and third signals. The controller 35 operates such that (i) the controller 35 receives a coin discharging command signal to start the motor to rotate forward or reversely when the coin guiding means 7 is in a standby state as shown in FIG. 7, that is, when the sliding plate 4 is in its non-play position, (ii) the controller 35 receives the signals produced from the first and second switches $S_1$ and $S_2$ to relatively reverse the rotation of the motor 37 (that is, to move the sliding plate 4 reversely to the direction so far, and (iii) the controller 35 counts the number of drops of the coins corresponding to an amount of predetermined discharge money in response to the third signal and then stops the rotation of the motor 37 when the sliding plate 4 has returned to the non-play position.

In the embodiment, the reference numerals 39 and 40 designate a carrying handle and a viewing window for checking up the state of piling of coins in the coin cases, respectively. As shown in FIG. 2, it is convenient that the upper left or right half portion of the housing 11 is pivoted at the pivot pin 38 so as to make the upper left or right half portion openable as shown by a phantom line in the drawing.

In the embodiment of the apparatus having a configuration as described above, however, it has been found there exists the following disadvantage when the coin receiving unit 3 is separated from the coin discharging unit 20 to repair the apparatus or to adjust the coin discharging function. That is, if the units 3 and 20 are separated from each other, the sliding plate 4 is disengaged from the pivotal lever 8 of the driving means so that the sliding plate 4 becomes movable forward/rearward freely. As a result, coins in the coin cases 2*a* and 2*b* are allowed to accidentally drop through the coin accepting hole 5 and the coin passing hole 17 as the sliding plate 4 moves. Further, when the units 3 and 20 are connected to each other again, the position of the sliding plate 4 is uncertain so that it is troublesome to make the sliding plate 4 engage with the pivotal lever 8.

In order to eliminate the above disadvantage, the inventors of this application have improved the coin guiding means 7 in a manner so that there is provided locking means 42 for releasably locking the sliding plate 4 at the non-play position shown in FIG. 1 when the units 3 and 20 are separated from each other.

Figure 8A:
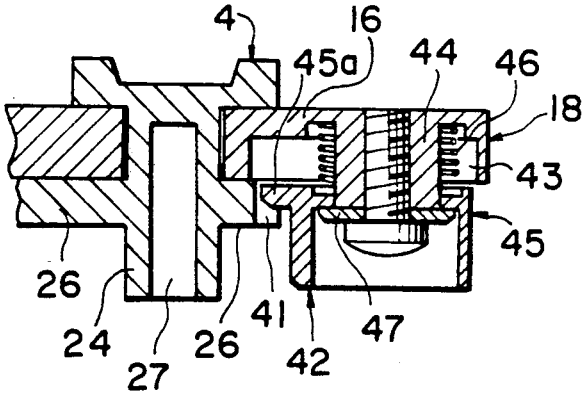
FIGS. 8*a* and 8*b* are longitudinal sectional views of the main portion of the coin guiding means of FIG. 7.
Figure 8B:
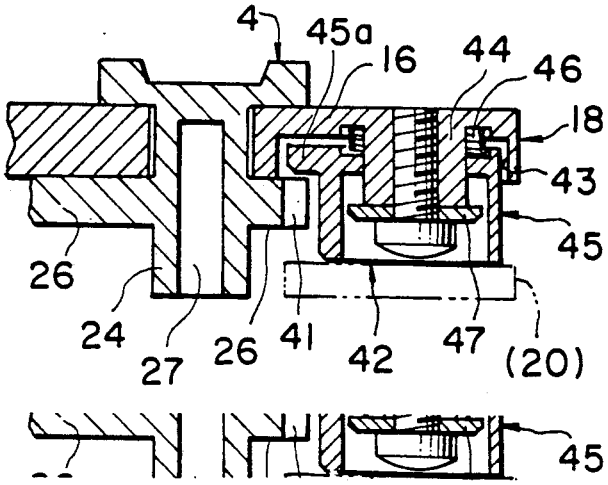
Figure 9A:
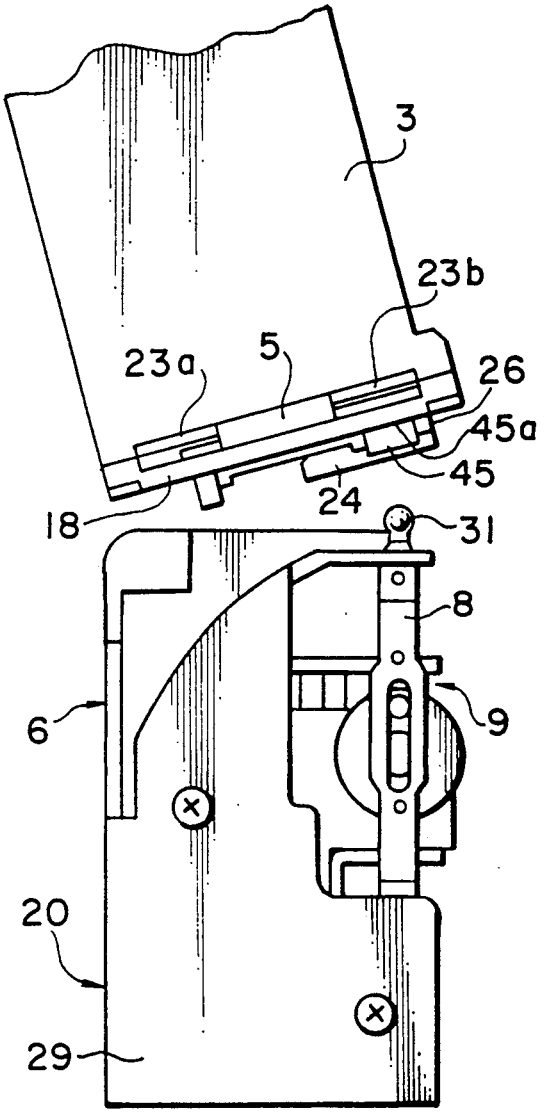
FIGS. 9*a* and 9*b* are side views of the coin receiving unit provided with the coin guiding means of FIG. 7 and the coin discharging unit which are separated from and coupled with each other, respectively.
Figure 9B:
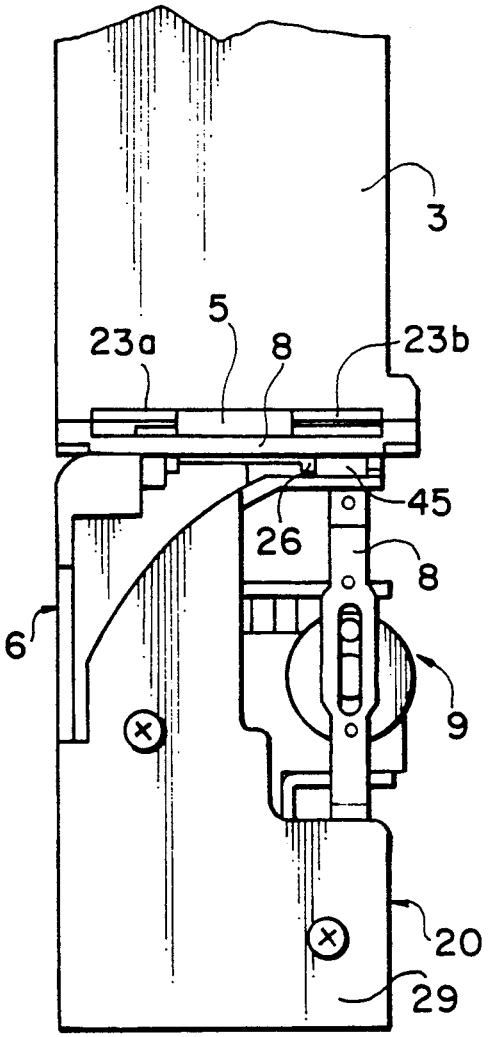

Referring to FIGS. 7, 8*a* and 8*b*, the locking means 42 is constituted by: a concavely notched portion 41 formed in the longitudinal free edge of one of the pair of support strips 26 of the engage member 24 of the sliding plate 4; a downward open recess 43 formed, adjacent to the notched portion 41, in the lower surface of the quadrangular plate 16 of the guide member 18; a guide shaft 44 projected downward from the bottom portion of the recess 43 so as to define an annular space between the inner circumferential surface of the recess 43 and the guide shaft 44; a sleeve 45 surrounding the guide shaft 44 so as to vertically movable along the guide shaft 44, the sleeve 45 having an upper end surface through which the guide shaft 44 slidably penetrates and a free lower end which is in contact with the upper surface of the coin discharging unit 20 so as to be urged by the latter; spring means 46 inserted between the bottom portion of the recess 43 and the upper end surface of the sleeve 45 so as to urge the upper end surface of the sleeve 45 against a sleeve stopper 47 fixed on the free lower end of the guide shaft 44; and a hemicircular protrusion 45*a* projected from the upper end surface of the sleeve 45 toward the inner circumference of the recess 43 so as to define a gap between the protrusion 45*a* and the inner circumference of the recess 43. In the state in which the coin receiving unit 3 is mounted on the coin discharging unit 20 as shown in FIG. 8*b*, the sleeve 45 is pressed up against the spring means 46, so that the hemicircular protrusion 45*a* exists inside the recess 43 and the sliding plate 4 is moved forward/rearward by the driving means. When the units 3 and 20 are separated from each other as shown in FIG. 8*a*, on the contrary, the sleeve 45 is pressed down by the spring means 46, so that the protrusion 45*a* is frictionally engaged with the notched portion 41 of the support strip 26 and thereby the sliding plate 4 is locked at the non-play position.

Referring to FIG. 1 and FIGS. 6*a* through 6*f*, the coin discharging operation mechanism of the apparatus of the embodiment will be described hereunder. When the apparatus is in the standby state for coin discharge as shown in FIG. 1, the pivotal lever 8 is substantially vertical and the coin accepting hole 5 of the sliding plate 4 is located so as to coaxially agree with the coin passing hole 17 of the guide member 18 opened over the respective open lower ends of the coin cases 2*a* and 2*b* aligned side by side in the forward/rearward direction, the coins in the coin cases 2*a* and 2*b* being laid on the upper surface of the sliding plate 4.

Figure 6C:
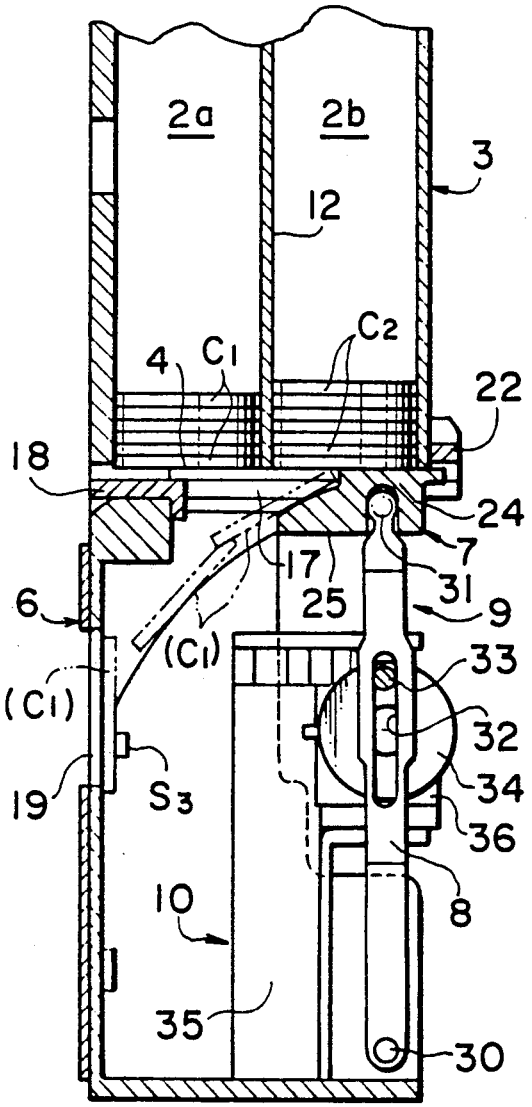

For example, when the coins $C_1$ stored in the front coin case 2*a* are to be discharged in the above-mentioned state, a coin discharging command signal is applied to the controller 35 to start the motor 37, the rotary disc 34 is rotated through the gearing mechanism 36 counterclockwise by a predetermined angle in FIG. 1, and the pivotal lever 8 is inclined forward through the engagement between the slide slot 32 and the crank pin 33 as shown in FIG. 6*a*. As the pivotal lever 8 is inclined, the sliding plate 4 is moved forward through the engagement between the upper end 31 of the pivotal lever 8 and the socket 27 of the sliding plate 4. The coin accepting hole 5 of the sliding plate 4 accepts one of the coins $C_1$ when the coin accepting hole 5 has come to completely communicate with the open lower end of the front coin case 2*a* as shown in FIG. 6*b*. At the same time, the first switch $S_1$ sends the first signal to the controller 35, for example, in response to the operation of the rotary disc 34, and the controller 35 makes the motor 37 rotate reversely to the direction so far in response to the signal so as to rotate the rotary disc 34 clockwise by the predetermined angle, whereby the sliding plate 4 is retreated to return to the initial stand-by position as shown in FIG. 6*c*. Upon completion of counting a predetermined number of drops of the coins in response to the third signal produced from the third switch $S_3$, the controller 35 stops the rotation of the motor 37. On the other hand, in the returning process of the sliding plate 4, one coin $C_1$ captured into the coin accepting hole 5 is dropped into the coin passing hole 17 of the guide member 18 and is succeedingly guided from the coin passing hole 17 into the coin discharge opening 19 while being guided by the inclined surface 25*a* of the protrusion 25 of the engage member 24 and the coin guiding surface 6*a* provided in the coin discharge section 6 as shown by a phantom line in FIG. 6*c*. The operation described above is repeated so that the coins $C_1$ stored in the front coin case 2*a* are succeedingly discharged.

Figure 6D:
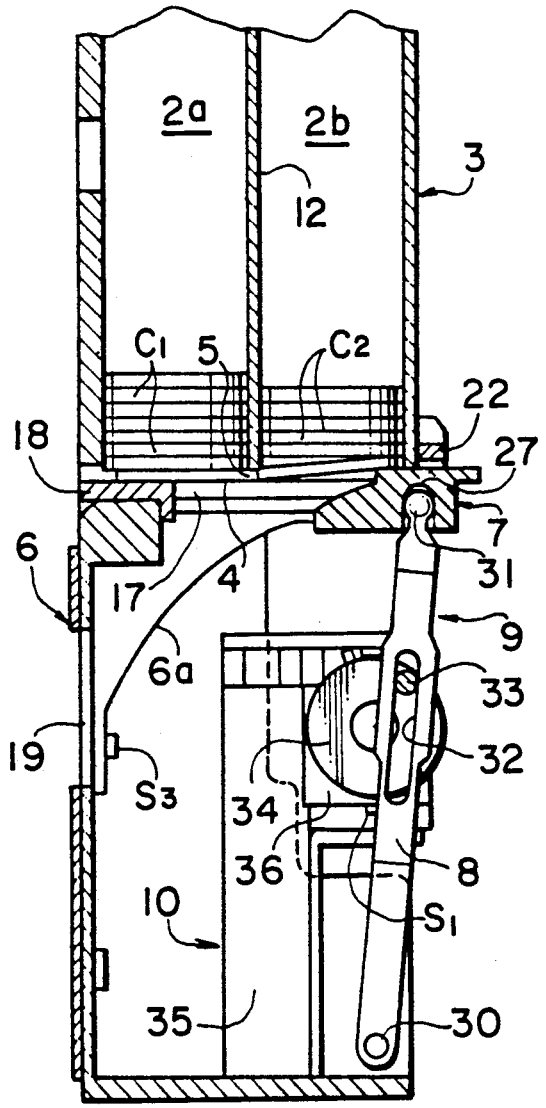
Figure 6E:
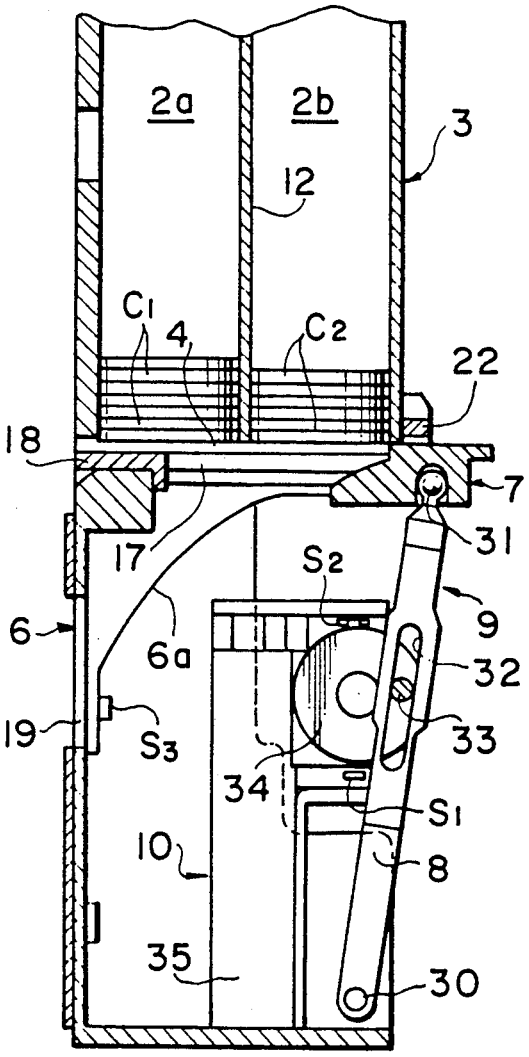
Figure 6F:
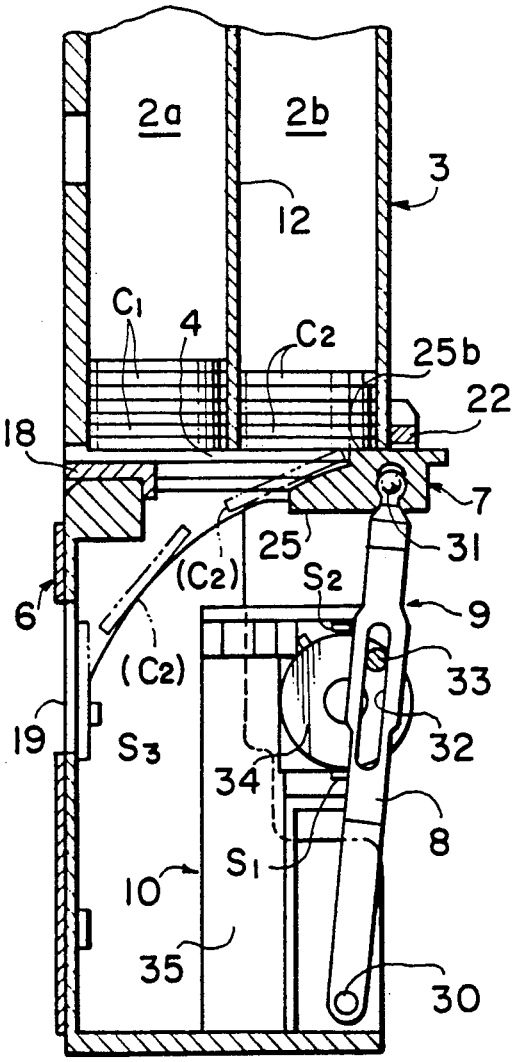

When the coins $C_2$ stored in the rear coin case 2*b* are to be discharged, in the coin discharge stand-by state described above (see FIG. 1), the rotary disc 34 is rotated clockwise by a predetermined angle through the operation of the controller 35 and the motor 37, so that the pivotal lever 8 is inclined rearward, as shown in FIG. 6*d*, to thereby move the sliding plate 4 rearward. Further, when the sliding plate 4 is moved rearward to the position shown in FIG. 6*e*, the coin accepting hole 5 accepts one coin $C_2$ from the rear coin case 2*b*. At the same time, the second switch $S_2$ produces the second signal so that the controller 35 makes the motor 37 rotate reversely in response to the signal so as to rotate the rotary disc 34 counterclockwise by the predetermined angle. As a result, the sliding plate 4 is advanced to return into the initial stand-by state. In the returning process, the coin $C_2$ captured in the coin accepting hole 5 is passed through the coin passing hole 17 of the guide member 18 to reach the discharge opening 19 of the coin discharge section 6 as shown by a phantom line in FIG. 6*f*. When the coin $C_2$ has reached the coin discharge opening 19, the third switch $S_3$ produces a third signal. After the controller 35 has counted a predetermined number of drops of the coins in response to the third signal produced from the third switch $S_3$, and when the sliding plate 4 has returned to the initial stand-by state, controller 35 stops the rotation of the motor 37. The operation described above is repeated so that the coins $C_2$ stored in the rear coin case 2*b* are succeedingly discharged.

In the manner as described above, the coins $C_1$ stored in the front coin case 2*a* and the coins $C_2$ stored in the rear coin case 2*b* can be selectively discharged through the forward-half reciprocating operation of the sliding plate 4 and through the rearward-half reciprocating operation of the sliding plate 4, respectively. Accordingly, the structure of the apparatus is effective in the case where the coins $C_1$ and the coins $C_2$ are made different from each other in kind of money, and in the case where the coins $C_1$ and $C_2$ are the same in kind of money, and, after completion of preceding coin discharge from any one of the coin cases 2*a* and 2*b*, the coin discharge path is changed over so that coins are supplemented into the one coin case while coin discharge operation is carried out from the other coin case, and so on.

Alternatively, in place of the operation described above, the driving of the motor 37 may be controlled so that the coin accepting hole 5 is reciprocatively operated over the front and rear coin cases 2*a* and 2*b* without dividing the operation into the forward-half reciprocation and the rearward-half reciprocation as described above. In this case, the coins stored in the coin cases 2*a* and 2*b* are discharged alternately from the coin cases 2*a* and 2*b*. Alternatively, the motor may be continuously rotated in one and the same direction so that the rotary disc 34 is rotated only in one direction so as to discharge coins alternately from the coin cases 2*a* and 2*b*. That is, for example, if the rotary disc 34 is made to rotate counterclockwise from the coin discharge stand-by state shown in FIG. 1, the sliding plate 4 is shifted from the state shown in FIG. 1 successively to the states shown in FIGS. 6*a*, 6*b*, and 6*c* so that one of the coins $C_1$ stored in the front coin case 2*a* is first discharged, and succeedingly the sliding plate 4 is shifted successively to the states shown in FIGS. 6*d*, 6*e*, and 6*f* so as to return to the state in FIG. 1 again so that one of the coins $C_2$ stored in the rear coin case 2*b* is discharged. Thus, two coins can be discharged at each reciprocation of the sliding plate 4 through each rotation of the rotary disc 34.

This invention may be practiced or embodied in still other ways without departing from the spirit or essential character thereof. For instance, while in the illustrated preferred embodiments the front and rear coin cases are shaped to have a quadrangular horizontal cross-section and provided with means for selectively introducing coins into the two coin cases, the respective coin cases may alternately be shaped in the form of a cylindrical tube or a hollow square pillar either of which has an upper end for inserting therethrough the coins into the tube or the pillar. In this modified form, the invention pertains to a coin discharging apparatus simply provided with front and rear coin cases rather than a coin receiving and discharging apparatus as disclosed hereinbefore. As a matter of course, the coin discharging apparatus according to the invention comprises the coin guiding means, the coin discharge section, the driving means and the controlling means all of which are disclosed in the foregoing. The preferred embodiments described herein are therefore illustrative and not restrictive, the scope of the invention being indicated by the appended claims and all variations which come within the meaning of the claims are intended to be embraced therein.

What is claimed is:

1. A coin receiving and discharging apparatus comprising a coin receiving unit and a coin discharging unit, said coin receiving unit and said coin discharging unit being removably coupled with each other:

wherein said coin receiving unit includes:

a housing vertically extending in the form of a hollow square pillar and having a front side, a rear side and left and sides, said housing being longer in depth than in width;

front and rear coin cases formed by dividing the interior of said housing with a partition plate extending in parallel with said front and rear sides of said housing for receiving coins in a horizontally piled state, said front and rear coin cases having respectively open lower ends positioned in one and the same horizontal plane;

a pair of coin inserting slits formed in an upper portion of said front side of said housing, and including a vertically elongated slit for inserting a coin therethrough into said front coin case and a horizontally elongated slit for inserting another coin therethrough into said rear coin case, said vertical and horizontal slits being combined with each other to form a T-shaped coin inlet;

coin introducing means provided in said housing for selectively introducing coins from said respective coin inserting slits into said front coin case and said rear coin case, and including a guide plate arranged to connect a lower edge of said horizontal slit and an upper end of said partition plate so as to incline downward toward said upper end, whereby a coin inserted through said horizontal slit is slid down on said guide plate and dropped into said rear coin case, and an elongated slit formed in said guide plate between said vertical slit and said upper end so as to enable another coin to vertically wholly enter from said vertical slit into said front coin case;

coin guiding means provided under said front and rear coin cases for selectively accepting one of two coins lying in the respective lowest layers in said front and rear coin cases and successively dropping said one coin into said coin discharging unit, said coin guiding means having a plate-like guide member horizontally secured to said respective open lower ends of said front and rear coin cases and having a coin passing hole the diameter of which is not less than a coin diameter and the central axis of which is positioned just under a lower end of said partition plate, and a sliding plate mounted on an upper surface of said guide member so as to be reciprocal forward/rearward between said open lower ends and said guide member and having a coin accepting hole which has a diameter not less than the coin diameter and an edge thickness substantially equal to a coin thickness and traverses right over said coin passing hole of said guide member when said sliding plate is reciprocated, said sliding plate having a socket formed in a lower surface thereof to open downward; and wherein said coin discharging unit includes:

a coin discharging section detachably disposed under said coin guiding means of said coin receiving unit for discharging a coin dropped by said coin guiding means to the exterior of said coin discharging unit;

driving means detachably engaged with said socket of said sliding plate of said coin guiding means for horizontally reciprocating said sliding plate forward and rearward; and controlling means for selectively controlling said driving means so that said sliding plate of said coin guiding means is moved to accept one of the coins in said front and rear coin cases into said coin accepting hole of said sliding plate and successively to drop the coin into said coin discharging section at each reciprocation of said sliding plate.

2. The coin receiving and discharging apparatus according to claim 1, wherein said guide member of said coin guiding means has a guide slit formed in a rear portion of said guide member so as to extend along a longitudinal center line of said rear portion to communicate at one end thereof with said coin passing hole and to open at the other end in a rear edge of said rear portion; and wherein said sliding plate of said coin guide means includes a base plate slidably mounted on said guide member and having a thickness substantially equal to the coin thickness, said base plate having a wide front portion in which said coin accepting hole is formed and a narrow rear portion and an engage member secured onto a lower surface of said narrow rear portion so as to be inserted into and slidably engaged with said guide slit of said guide member and further protruded downward out of said guide slit, said engage member having a lower surface in which said socket is formed, and a pair of support strips secured onto the respective opposite side surfaces of said engage member so as to slidably insert said rear portion of said guide member between said narrow rear portion and said support strips.

3. The coin receiving and discharging apparatus according to claim 1, wherein said coin discharge section has a coin discharge opening formed in a front side thereof and a coin guiding surface provided in said coin discharge section for guiding a coin dropped from said coin guiding means to said coin discharge opening.

4. The coin receiving and discharging apparatus according to claim 1, wherein said driving means includes a driving motor, a rotary disc rotated by said driving motor through a gearing mechanism operatively connected to said motor and said rotary disc, and a movement converting mechanism for converting the rotation of said rotary disc into a horizontal liner movement of said sliding plate of said coin guiding means.

5. The coin receiving and discharging apparatus according to claim 4, wherein said movement converting mechanism includes a crank pin formed on a circumferential portion of said rotary disc; a pivotal lever substantially vertically extending adjacent to and parallel with said rotary disc and having a lower end pivotably connected to a rear and lower portion of said coin discharging unit and a hemispherical upper end detachably slidably engaged with said socket of said sliding plate of said coin guiding means; and a slide slot formed in a middle portion of said pivotal lever to elongate along said lever, said crank pin being inserted into and slidably engaged with said slide slot.

6. The coin receiving and discharging apparatus according to claim 4, wherein said controlling means includes a first switch actuated when said coin accepting hole of said sliding plate being moved in located just under said open lower end of said front coin case and having means for making a first output signal corresponding to the actuation of said first switch; a second switch actuated when said coin accepting hole being moved is located just under said open lower end of said rear coin case and having means for making a second output signal corresponding to the actuation of said second switch; a third switch actuated whenever a coin is dropped from said coin guiding means to said coin discharging section and having means for making a third output signal corresponding to each drop of coins; and a controller receiving said first, second and third output signals from said first, second and third switches and controlling said motor to reverse the direction of rotation of said motor in response to each of said first, second and third output signals and to stop said motor when said sliding plate returns to a non-play position after said controller has counted a predetermined number of drops of coins in response to said third output signal.

7. The coin receiving and discharging apparatus according to claim 4, wherein said driving motor is driven to rotate only in one direction of rotation; and wherein said movement converting mechanism is operative to reciprocate said sliding plate so that said coin accepting hole can accept two coins respectively from said front and rear coin cases at each reciprocation of said sliding plate; and wherein said controlling means includes a switch actuated whenever a coin is dropped from said coin guiding means to said coin discharging section and having means for making an output signal corresponding to each drop of coins, and a controller receiving said output signal from said switch and controlling said motor in manner so that said motor is stopped when said sliding plate returns to its non-play position after said controller has counted a predetermined number of drops of coins in response to said output signal.

8. The coin receiving and discharging apparatus according to claim 2, wherein said coin guiding means is provided with locking means for releasably locking said sliding plate in a non-play position when said coin receiving unit and said coin discharging unit are separated from each other.

9. The coin receiving and discharging apparatus according to claim 8, wherein said locking means includes a concavely notched portion formed in a free edge of one of said support strips of said engage member; a hollow formed adjacent to said notched portion and in the lower surface of said plate-like guide member and opened downward; a guide shaft protruded downward from a bottom of said hollow and through said hollow with an annular space between said guide shaft and said hollow; a sleeve receiving said guide shaft and movable up and down within said annular space, said sleeve having an upper end thereof slidably receiving said guide shaft and an open lower end to be contacted with and pushed by an upper face of said coin discharging unit; spring means interposed between the bottom of said hollow and the upper end of said sleeve for urging the upper end of said sleeve against a stopper secured on a free lower end of said guide shaft; and a hemicircular protrusion protruded toward a peripheral surface of said hollow, with a gap therebetween, from the upper end of said sleeve, said hemicircular protrusion being pushed down by said spring means and frictionally engaged with said notched portion of said support strip when said coin receiving unit is separated from said coin discharging unit to thereby lock said sliding plate in a non-play position.

10. A coin receiving and discharging apparatus comprising a coin receiving unit and a coin discharging unit, said coin receiving unit and said coin discharging unit being removably coupled with each other:

wherein said coin receiving unit includes:

a housing vertically extending in the form of a hollow square pillar and having a front side, a rear side and left and sides, said housing being longer in depth than in width;

front and rear coin cases formed by dividing the interior of said housing with a partition plate extending in parallel with said front and rear sides of said housing for receiving coins in a horizontally piled state, said front and rear coin cases having respectively open lower ends positioned in one and the same horizontal plane;

a pair of coin inserting slits formed in an upper portion of said front side of said housing;

coin introducing means provided in said housing for selectively introducing coins from said coin inserting slits into said front coin case and said rear coin case; and coin guiding means for selectively accepting one of two coins lying in the respective lowest layers in said front and rear coin cases and successively dropping said coin into an interior lower portion of said coin discharging apparatus, said coin guiding means comprising a plate-like guide member horizontally secured to said respective open lower ends of said front and rear coin cases and having a coin passing hole the diameter of which is not less than a coin diameter and the central axis of which is positioned just under the center of lower end of said partition plate, said guide member having a guide slit formed in a rear portion of said guide member so as to extend along a longitudinal center line of said rear portion to communicate at one end thereof with said coin passing hole and to open at the other end in a rear edge of said rear portion, and a sliding plate mounted on an upper surface of said guide member so as to be reciprocal in the forward and rearward direction between said open lower ends and said guide member and having a coin accepting hole which has a diameter not less than that of the coin diameter and an edge thickness substantially equal to a coin thickness and traverses right over said coin passing hole of said guide member when said sliding plate is reciprocated, said sliding plate including a base plate slidably mounted on said guide member and having a thickness substantially equal to the coin thickness, said base plate having a wide front portion in which said coin accepting hole is formed, a narrow rear portion and an engage member secured onto a lower surface of said narrow rear portion so as to be inserted into and slidably engaged with said guide slit of said guide member and further protruded downward out of said guide slit, said engage member having a pair of support strips secured onto the respective opposite side surfaces of said engage member so as to slidably insert said rear portion of said guide member between said narrow rear portion and said support strips; and wherein said coin discharging unit includes:

a coin discharge section detachably disposed under said coin guiding means for discharging a coin dropped by said coin guiding means to the exterior of said coin discharging apparatus;

driving means disposed adjacent to said coin discharge section and detachably engaged with said sliding plate of said coin guiding means for horizontally reciprocating said sliding plate forward and rearward;

controlling means for selectively controlling said driving means so that said sliding plate of said coin guiding means is moved to accept one of the coins in said front and rear coin cases into said coin accepting hole of said sliding plate and successively to drop the coin into said coin discharge section at each reciprocation of said sliding plate; and in which said coin guiding means is provided with locking means for releasably locking said sliding plate of said coin guiding means in a non-play position when said coin receiving unit and said coin discharging unit are separated from each other, said locking means including a concavely notched portion formed in a free edge of one of said support strips of said engage member; a hollow formed adjacent to said notched portion and in the lower surface of said plate-like guide member and opened downward; a guide shaft protruded downward from a bottom of said hollow and through said hollow with an annular space between said guide shaft and said hollow; a sleeve receiving said guide shaft and movable up and down within said annular space, said sleeve having an upper end thereof slidably receiving said guide shaft and an open lower end to be contacted with and pushed by an upper face of said coin discharged section; spring means interposed between the bottom of said hollow and the upper end of said sleeve for urging the upper end of said sleeve against a stopper secured on a free lower end of said guide shaft; and a hemicircular protrusion protruded toward a peripheral surface of said hollow, with a gap therebetween, from the upper end of said sleeve, said hemicircular protrusion being pushed down by said spring means and frictionally engaged with said notched portion of said support strips when said coin guiding means is separated from said coin discharge section.

11. A coin discharging apparatus comprising:

front and rear coin cases erected and aligned side by side adjacent to each other in the front and rear direction for receiving coins in a horizontally piled state, said front and rear coin cases having respectively open lower ends positioned in one and the same horizontal plane;

coin guiding means for selectively accepting one of two coins lying in the respective lowest layers in said front and rear coin cases and successively dropping said coin into an interior lower portion of said coin discharging apparatus, said coin guiding means comprising a plate-like guide member horizontally secured to said respective open lower ends of said front and rear coin cases and having a coin passing hole the diameter of which is not less than a coin diameter and the central axis of which is positioned just under the center of a portion where said open lower ends of said front and rear coin cases are in contact with each other, said guide member having a guide slit formed in a rear portion of said guide member so as to extend along a longitudinal center line of said rear portion to communicate at one end thereof with said coin passing hole and to open at the other end in a rear edge of said rear portion, and a sliding plate mounted on an upper surface of said guide member so as to be reciprocal in the forward and rearward direction between said open lower ends and said guide member and having a coin accepting hole which has a diameter not less than the coin diameter and an edge thickness substantially equal to a coin thickness and traverses right over said coin passing hole of said guide member when said sliding plate is reciprocated, said sliding plate including a base plate slidably mounted on said guide member and having a thickness substantially equal to the coin thickness, said base plate having a wide front portion in which said coin accepting hole is formed, a narrow rear portion and an engage member secured onto a lower surface of said narrow rear portion so as to be inserted into and slidably engaged with said guide slit of said guide member and further protruded downward out of said guide slit, said engage member having a pair of support strips secured onto the respective opposite side surfaces of said engage member so as to slidably insert said rear portion of said guide member between said narrow rear portion and said support strips;

a coin discharge section detachably disposed under said coin guiding means for discharging a coin dropped by said coin guiding means to the exterior of said coin discharging apparatus;

driving means disposed adjacent to said coin discharge section and detachably engaged with said sliding plate of said coin guiding means for horizontally reciprocating said sliding plate forward and rearward;

controlling means for selectively controlling said driving means so that said sliding plate of said coin guiding means is moved to accept one of the coins in said front and rear coin cases into said coin accepting hole of said sliding plate and successively to drop the coin into said coin discharge section at each reciprocation of said sliding plate; and locking means for releasably locking said sliding plate of said coin guiding means in a non-play position when said coin guiding means and said coin discharged section are separated from each other, said locking means including a concavely notched portion formed in a free edge of one of said support strips of said engage member; a hollow formed adjacent to said notched portion and in the lower surface of said plate-like guide member and opened downward; a guide shaft protruded downward from a bottom of said hollow and through said hollow with an annular space between said guide shaft and said hollow; a sleeve receiving said guide shaft and movable up and down within said annular space, said sleeve having an upper end thereof slidably receiving said guide shaft and an open lower end to be contacted with and pushed by an upper face of said coin discharge section; spring means interposed between the bottom and said hollow and the upper end of said sleeve for urging the upper end of said sleeve against a stopper secured on a free lower end of said guide shaft; and a hemicircular protrusion protruded toward a peripheral surface of said hollow, with a gap therebetween, from the upper end of said sleeve, said hemicircular protrusion being pushed down by said spring means and frictionally engaged with said notched portion of said support strips when said coin guiding means is separated from said coin discharge section.

12. A coin apparatus comprising: a vertically elongated housing having a front side and having a greater depth than width; a partition forming front and rear vertical coin compartments in the housing; coin receiving means at an upper portion of the front side comprising a T-shaped coin inlet for receiving coins including a vertical slit and a horizontal slit; and guide means connected between a lower edge of the horizontal slit and an upper end of the partition for preventing coins received through the horizontal slit from falling into the front coin compartment and for guiding coins received through the horizontal slit into the rear coin compartment and having a slit therein for permitting a coin received through the vertical slit to fall into the front coin compartment.

13. The apparatus according to claim 12, further comprising means for selectively removing coins from a lower portion of the coin compartments comprising a guide member horizontally disposed at a bottom of the front and rear coin compartments and having a coin passing hole therein with a diameter not less than the diameter of coins to be received through the coin inlet and a central axis disposed directly aligned with the partition, a sliding plate disposed on an upper surface of the guide member and having a thickness substantially equal to a thickness of coins received through the coin inlet and a coin accepting hole having a diameter not less than the diameter of coins to be received through the coin inlet and means for moving the sliding plate to selectively receive coins from the front and rear compartments and effect passage through the coin passing hole in the guide member.

14. The apparatus according to claim 13, further comprising a coin discharge compartment removably connected to the housing for receiving coins passing through the coin passing hole.

15. The apparatus according to claim 13, wherein said guide member has a guide slit formed in a rear portion of said guide member so as to extend along a longitudinal center line of said rear portion to communicate at one end thereof with said coin passing hole and to open at the other end in a rear edge of said rear portion; and wherein said sliding plate has a wide front portion in which said coin accepting hole is formed and a narrow rear portion and an engage member secured onto a lower surface of said narrow rear portion so as to be inserted into and slidably engaged with said guide slit of said guide member and further protruded downward out of said guide slit, said engage member having a lower surface in which a socket is formed, and a pair of support strips secured onto the respective opposite side surfaces of said engage member so as to slidably insert said rear portion of said guide member between said narrow rear portion and said support strips.

16. The apparatus according to claim 14, wherein said coin discharge compartment has a coin discharge opening formed in a front side thereof and a coin guiding surface for guiding a coin passing through the coin passing hole to said coin discharge opening.

17. The apparatus according to claim 15, wherein the means for moving the sliding plate includes a driving motor, a rotary disc rotated by said driving motor through a gearing mechanism operatively connected to said motor and said rotary disc, and a movement converting mechanism for converting the rotation of said rotary disc into a horizontal liner movement of said sliding plate.

18. The apparatus according to claim 17, wherein said movement converting mechanism includes a crank pin formed on a circumferential portion of said rotary disc; a pivotal lever substantially vertically extending adjacent to and parallel with said rotary disc and having a lower end pivotably connected to a rear and lower portion of said coin discharging unit and a hemispherical upper end detachably slidably engaged with said socket of said sliding plate of said coin guiding means; and a slide slot formed in a middle portion of said pivotal lever to elongate along said lever, said crank pin being inserted into and slidably engaged with said slide slot.

19. The apparatus according to claim 17, further comprising means for controlling the moving means comprising a first switch for producing a first output signal when said coin accepting hole of said sliding plate is moved under a lower end of said front coin compartment; a second switch for producing a second output signal when said coin accepting hole is moved under a lower end of said rear coin compartment; a third switch for producing a third signal whenever a coin passes to said coin discharging compartment; and a controller receptive of said first, second and third output signals for reversing the direction of rotation of said motor in response to each of said first, second and third output signals and to stop said motor when said sliding plate returns to a non-play position after said controller has counted a predetermined number of drops of coins in response to said third output signal.

20. The apparatus according to claim 17, wherein said driving motor is driven to rotate only in one direction of rotation and wherein said movement converting mechanism reciprocates said sliding plate to accept two coins from said front and rear coin compartments at each reciprocation of said sliding plate and further comprising a switch for producing an output signal whenever a coin is passed to said coin discharging compartment and a controller receiving said output signal from said switch and controlling said motor to stop when said sliding plate returns to a non-play position after said controller has counted a predetermined number of drops of coins in response to said output signal.

21. The apparatus according to claim 15, further comprising locking means for releasably locking said sliding plate in a non-play position when said housing and said coin discharging compartments are disconnected from each other.

22. The apparatus according to claim 21, wherein said locking means includes a concavely notched portion formed in a free edge of one of said support strips of said elongated engage member; a hollow formed adjacent to said notched portion and in the lower surface of said plate-like guide member and opened downward; a guide shaft protruded downward from a bottom of said hollow and through said hollow with an annular space between said guide shaft and said hollow; a sleeve receiving said guide shaft and movable up and down within said annular space, said sleeve having an upper end thereof slidably receiving said guide shaft and an open lower end to be contacted with and pushed by an upper face of said coin discharging unit; spring means interposed between the bottom of said hollow and the upper end of said sleeve for urging the upper end of said sleeve against a stopper secured on a free lower end of said guide shaft; and a hemicircular protrusion protruded toward a peripheral surface of said hollow, with a gap therebetween, from the upper end of said sleeve, said hemicircular protrusion being pushed down by said spring means and frictionally engaged with said notched portion of said support strip when said housing is separated from said coin discharging compartment to thereby lock said sliding plate in a non-play position.

23. A coin apparatus comprising: a vertically elongated housing having a front side and having a greater depth than width; a partition forming front and rear vertical coin compartments in the housing; coin receiving means at an upper portion of the front side comprising a coin inlet for receiving coins; means for selectively removing coins from a lower portion of the coin compartments comprising a guide member horizontally disposed at a bottom of the front and rear coin compartments and having a coin passing hole therein with a diameter not less than the diameter of coins to be received through the coin inlet and a central axis disposed directly aligned with the partition, a sliding plate disposed on an upper surface of the guide member and having a thickness substantially equal to a thickness of coins received through the coin inlet and a coin accepting hole having a diameter not less than the diameter of coins to be received through the coin inlet and means for moving the sliding plate to selectively receive coins from the front and rear compartments and effect passage through the coin passing hole in the guide member; a coin discharged compartment removably connectable to the housing for receiving coins passing through the coin passing hole; wherein said guide member has a guide slit formed in a rear portion of said guide member so as to extend along a longitudinal center line of said rear portion to communicate at one end thereof with said coin passing hole and to open at the other end in a rear edge of said rear portion; and wherein said sliding plate has a wide front portion in which said coin accepting hole is formed and a narrow rear portion and an engage member secured onto a lower surface of said narrow rear portion so as to be inserted into and slidably engaged with said guide slit of said guide member and further protruded downward out of said guide slit, said engage member having a lower surface in which a socket is formed, and a pair of support strips secured onto the respective opposite side surfaces of said engage member so as to slidably insert said rear portion of said guide member between said narrow rear portion and said support strips; locking means for releasably locking said sliding plate in a non-play position when said housing and said coin discharging compartments are disconnected from each other, wherein said locking means includes a concavely notched portion formed in a free edge of one of said support strips of said elongated engage member; a hollow formed adjacent to said notched portion and in the lower surface of said plate-like guide member and opened downward; a guide shaft protruded downward from a bottom of said hollow and through said hollow with an annular space between said guide shaft and said hollow; a sleeve receiving said guide shaft and movable up and down within said annular space, said sleeve having an upper end thereof slidably receiving said guide shaft and an open lower end to be contacted with and pushed by an upper face of said coin discharging unit; spring means interposed between the bottom of said hollow and the upper end of said sleeve for urging the upper end of said sleeve against a stopper secured on a free lower end of said guide shaft; and a hemicircular protrusion protruded toward a peripheral surface of said hollow, with a gap therebetween, from the upper end of said sleeve, said hemicircular protrusion being pushed down by said spring means and frictionally engaged with said notched portion of said support strip when said housing is separated from said coin discharging compartment to thereby lock said sliding plate in a non-play position.

* * * * *